United States Patent [19]

Eckel

[11] 4,074,489

[45] Feb. 21, 1978

[54] WALL PANEL ASSEMBLY

[75] Inventor: Alan Eckel, Westford, Mass.

[73] Assignee: Eckel Industries, Inc., Cambridge, Mass.

[21] Appl. No.: 727,034

[22] Filed: Sept. 27, 1976

Related U.S. Application Data

[63] Continuation-in-part of Ser. No. 643,698, Dec. 13, 1975.

[51] Int. Cl.[2] ..... E04B 1/00

[52] U.S. Cl. ..... 52/272; 52/284; 52/288

[58] Field of Search ..... 52/272, 273, 274, 275, 52/278, 284, 285, 288

[56] References Cited

U.S. PATENT DOCUMENTS

| | | | |
|---|---|---|---|
| 1,829,331 | 10/1931 | Barker et al. | 52/272 |
| 2,211,644 | 8/1940 | Buck et al. | 52/272 X |
| 2,822,898 | 2/1958 | Richards | 52/464 X |
| 2,876,275 | 3/1959 | Schulz | 52/272 X |
| 3,332,190 | 7/1967 | Ekstrom | 52/464 |
| 3,765,138 | 10/1973 | Bentle | 52/288 X |
| 3,783,174 | 1/1974 | Lindgren | 52/285 X |

FOREIGN PATENT DOCUMENTS

| | | | |
|---|---|---|---|
| 1,088,632 | 9/1954 | France | 52/272 |

*Primary Examiner*—J. Karl Bell
*Attorney, Agent, or Firm*—Schiller & Pandiscio

[57] ABSTRACT

Various improvements of a modular wall assembly of the type having panels with channels formed along the side edges of the panels, are described. The improvements include corner connection means for providing a structurally improved corner connection between two panels, a window frame assembly useful with the panels and yet preserving the modular nature of the modular wall assembly and improved ceiling cap members and floor channel members for facilitating the assembly and disassembly of the wall assembly.

19 Claims, 8 Drawing Figures

10
12
14A
14B
16
18
20
22
24
28
28A
34
34A
38
39
40
42
44
46A
46B
47A
47B
48A
48B
49A
49B
50A
50B
94
96
100
104
114
122
124
126
10A
10B
12A
12B
32

WALL PANEL ASSEMBLY

RELATED APPLICATIONS

This application is a continuation-in-part of my copending application Ser. No. 643,698 filed Dec. 13, 1975.

This invention relates to panel assemblies and more particularly to panel assemblies of the modular type.

Modular acoustical panel assemblies are well known for providing sound absorbing and attenuating walls and ceilings which are easy to construct and build with minimum effort and skill. One commercially available acoustical panel assembly, which is described and claimed in my U.S. Pat. No. 3608260, includes a plurality of substantially flat panels, which are aligned with one another in a substantially coplanar relationship. The two side confronting edges of any two adjacent aligned panels are each provided with a "tongue" or "joiner" which extends parallel to and is spaced from the main body of the panel so as to form a space therebetween. The space is open along one side of the panel and the panels are alternately oriented so that the tongue of each panel extends into the space provided between the tongue and main body of the adjacent panel to provide an interlocking joint. Gaskets are provided in the tongue-receiving spaces of each panel to insure a tight fitting joint when the two panels are joined together. It has been found that this assembly does not provide relatively good acoustical insulation; nor is the assembly as structurally as sound as may be desired. Another problem with my prior design is that various modifications must be made to the assembly in order to run water lines, electrical cable and the like, along and through the wall formed by the assembly. Further if one side of each wall panel is perforated or otherwise made differently from its other side, on assembly every other panel will be reversed unless two types of panels are made (which would reduce or eliminate certain advantages of the modular nature of the assembly). The resulting wall construction may not only be aesthetically displeasing but also the reversal of the panels may affect the acoustical insulating or absorbing properties of the paneled wall.

In my copending application, U.S. Ser. No. 643,698, I describe a modular wall assembly which overcomes certain limitations of my prior acoustical panel assembly described and claimed in U.S. Pat. No. 3,608,260. The modular wall assembly of the copending application comprises at least two panel modules which are capable of being aligned and oriented with respect to one another so that the two side edges of the respective panels are in confronting and spaced relationship. Each panel includes a substantially flat body and at least one tongue. The tongue extends along a side edge of the panel substantially parallel to and spaced from the body so as to form a channel therebetween, the channel being open along one side of the panel. The panel assembly also inculdes connector means for connecting the panels together in an acoustically tight fashion. In order to connect the panels together in a coplanar relation, the connector means includes two, preferably U-shaped, connector members which are utilized to join together to two confronting side edges of two adjacent panels. Each connector member comprises two parallel side plates and a web or strap connected to and supporting the side plates. Each side plate of one connector member extends within a corresponding one of the channels of each panel where it makes a tight fit with the adjacent tongue and flat body. The other connector member is fitted between the two panels so its side plates extend in between and make a tight fit with the adjacent tongues of the two adjoining panels. Where two adjacent panels are to be connected so as to form a corner, the connector means comprises an L-shaped connector member, with each of its two side flanges extending within the channels of one of the adjacent panels and making a tight fit with the adjacent tongue and flat body of that panel. Means are also provided for reinforcing the upper and lower longitudinal edges of the panels, for securing the assembly to the floor and for mounting the ceiling panels to the panel wall assembly thus formed.

Objects of the present invention are to provide an improved modular assembly having the advantages of the assembly described in my copending application; to make the assembly and disassembly of such a wall assembly relatively easier; to improve the structural strength and integrity of the wall assembly, particularly at the corners formed by intersecting walls; and to provide a window frame assembly for use with such wall assemblies for supporting glazing units while preserving the modular nature and advantages of the wall assembly.

These and other objects are achieved by an improved corner connection means, one form of which includes one of the L-shaped connector members and two of the preferably U-shaped connector members of the type described in my copending application. The connector members can be interconnected together as well as with the tongues and bodies of at least two panels of the type described in my copending application to provide an improved corner structure. In another form of the invention the corner connection means comprises a corner connection member including a body having two mutually coverging side edges and a flange at each of said side edges of the corner member extending substantially parallel to and spaced from the body so as to form a channel at each side edge. Each of the two channels of the corner connection member are used with two of the U-shaped connector members to provide a corner connection to two panels forming a wall. Other objects of the present invention are achieved by an improved cap member for reinforcing the top horizontal edge of the wall panels and for supporting ceiling panels therefrom; by an improved floor channel member for receiving the bottom horizontal edge of the wall panels; and by a window frame assembly which can be used with the modular panels, while preserving the modular nature and advantages of the wall assembly.

Other features and many of the attendant advantages of the invention are disclosed in or rendered obvious by the following detailed description which is to be considered together with the accompanying drawings in which.

Figures 1, 3:
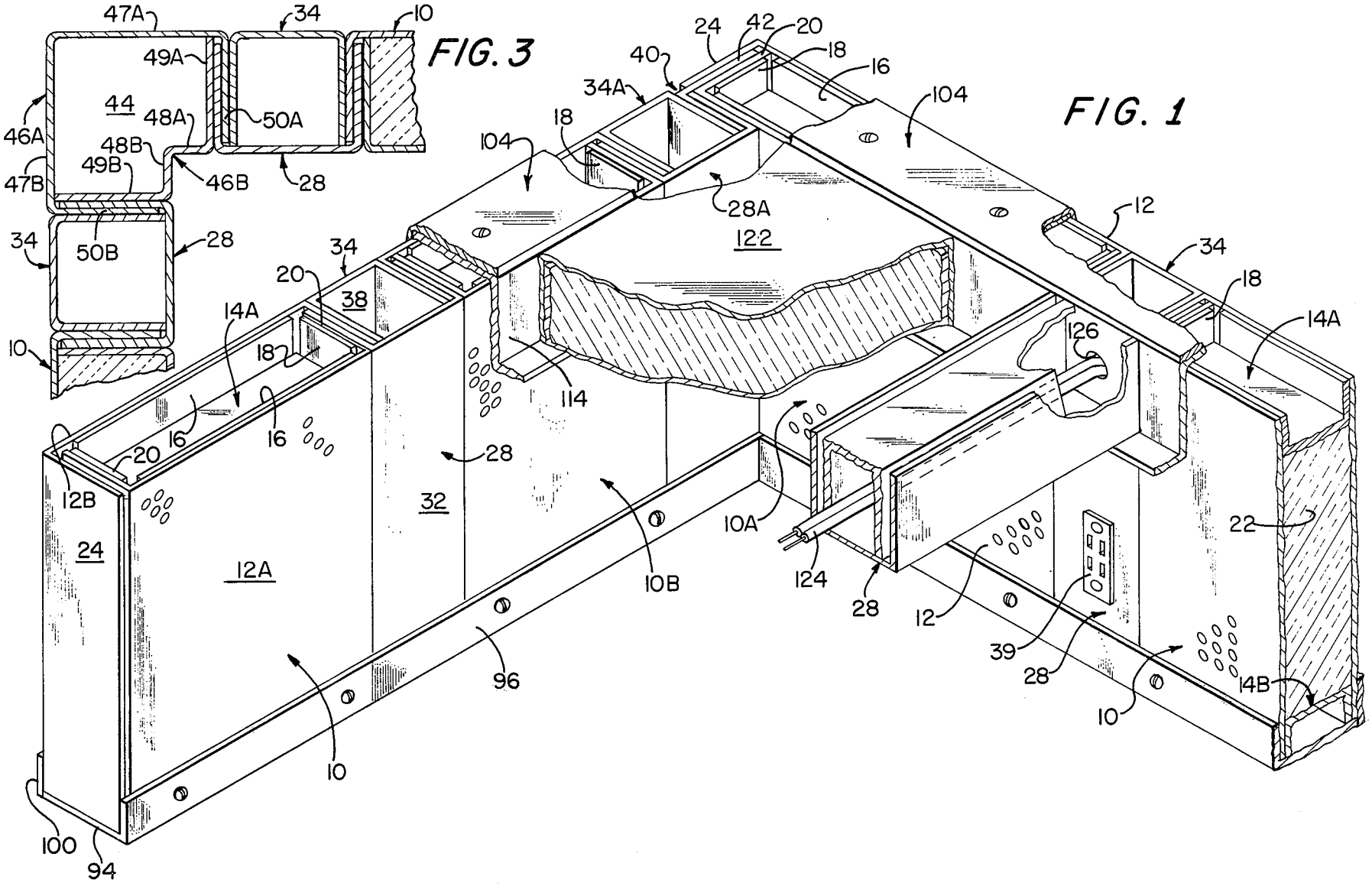
FIG. 1 is a fragmentary perspective view of a panel assembly comprising one embodiment of the corner connection means of the present invention.
FIG. 3 is a fragmentary plan sectional view illustrating a second embodiment of the corner connection means of the present invention.

In the drawings like numerals refer to like parts. Also, for convenience of illustration, the thickness of the panels is exaggerated in the drawings. In practice, for example, the panels may measure 4 feet wide, 8 feet high, and 2 inches thick.

The illustrated assembly comprises at least two sound absorbing panels 10 each including a pair of flat plates 12A and 12B mounted in a parallel and spaced relationship with respect to each other so as to form a substantially flat body.

While both of the plates may be perforated (so as to render it transparent to sound) or solid, in the preferred embodiment plate 12A is perforated and plate 12B is not perforated.

Figure 2:
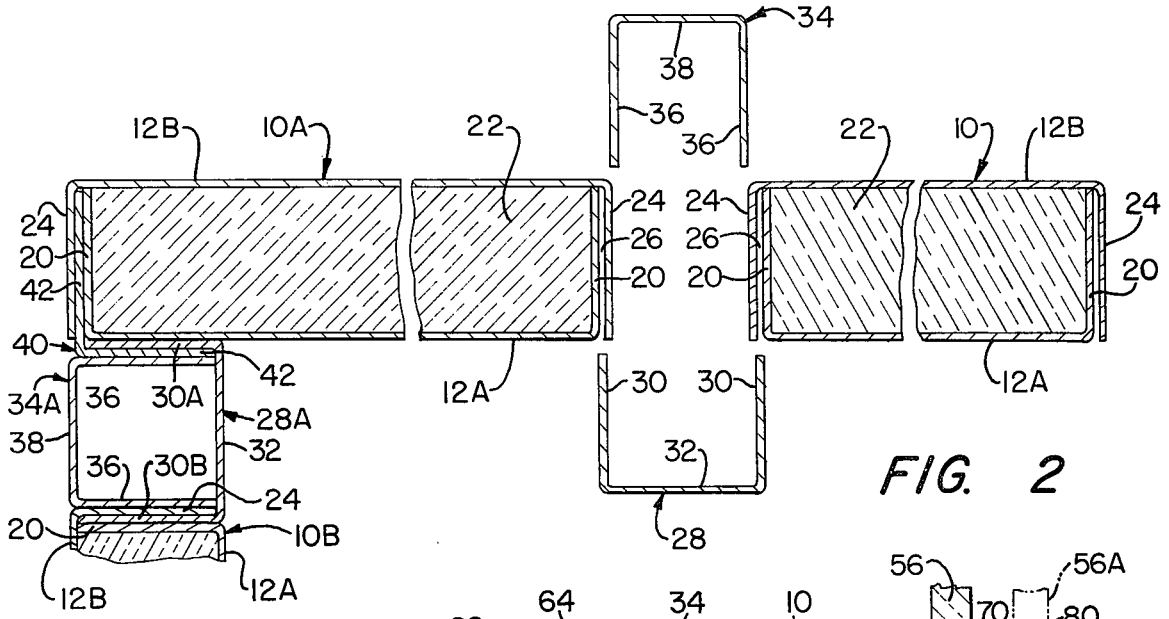
FIG. 2 is a fragmentary plan sectional view, partially exploded, of a portion of the structure of FIG. 1.

Both the top and bottom longitudinal edges of the two plates of each panel are secured together by stiffeners 14A and 14B. Each stiffener has a pair of side flanges 16 which are secured to the inside surfaces of plates 12A and 12B and end flanges 18 which extend transversely to and are spaced from the side flanges so as to provide a relief at each corner of the stiffener. Each plate 12A is provided with right angled side extensions 20 which are secured to the end flanges 18 of stiffeners 14A and 14B and serve as the side edges of the panel so as to enclose the space between plates 12A and 12B. The space is filled with a suitable sound absorbing material 22 such as glass fibers or a plastic foam. The other plate 12B is preferably formed with right angle side extensions 24, hereinafter referred to as "tongues 24". Each tongue extends along the entire side edge of the panel and is spaced from the side extensions 20 so as to form a channel 26 therebetween (see FIG. 2) which is open along the perforated plate side of the panel.

As described in my copending application Ser. No. 643,698, in order to connect two panels 10 together in a substantially coplanar relationship, connecting means in the form of a double channel connector is employed. Specifically, each double channel connector includes inner and outer U-shaped channel members 28 and 34, respectively. Channel member 28 has two parallel spaced side plates 30 and a strap or web portion 32 connected to and supporting the side plates a a right angle thereto. Channel members 28 preferably extend the full height of the panels. The two panels to be connected are spaced from one another so that the side plates 30 of the channel member 28 extend into corresponding ones of the channels 26 at the confronting side edges of the two panels. Each side plate 30 makes a snug, preferably tight, fit with the tongue 24 and extension 20 of a panel and when the side plates 30 are properly positioned in the channels, the web portion 32 of member 28 is preferably flush with the outer surfaces of the plates 12A of the two panels. The outer channel 34 coacts with the inner channel member 28 so as to make a substantially rigid joint between the two panels and also to provide greater structural support for the panels. The outer channel member 34 has parallel spaced-apart side plates 36 and a strap or web portion 38 connected to and supporting the side plates at a right angle thereto. The outer channel member also preferably extends for the full height of the panels. The outer channel member 34 makes a snug, preferably tight, fit between the two panels when the panels are coupled together by the inner channel member 28 as described and shown. Specifically, the side plates 36 of each channel member 34 extend between and make a snug, preferably tight, fit with the exterior surfaces of the tongues 24 of the two adjacent panels. The side plates 36 are dimensioned so that when the outer channel member 34 is properly in position between the panels, the web portion 38 is substantially flush with the plates 12B of the two adjacent panels, as shown in FIG. 1.

The double channel connector formed by the inner and outer channel members 28 and 34 not only provides a rigid vertical post in a coplanar relationship, but also forms a hollow column which can easily function as a raceway for electrical cables, piping and the like. Thus, for example, the web portion 32 of member 28 can be provided with an electrical receptable such as shown at 39.

In order to connect two of the panels 10 transversely to one another, so as to provide, for example, a corner formed by two intersecting walls, one embodiment of the improved corner connection means of the present invention includes an L-shaped or angle iron connector 40 (shown best in FIGS. 1 and 2) employed with a double channel connector formed by the inner and outer channel members 28 and 34. The connector 40 extends preferably for the full height of the panels and its two sides or flanges 42 are connected together at an angle of substantially 90°.

The two panels (indicated as 10A and 10B in FIG. 2) to be connected together are positioned at a right angle to one another and aligned and spaced so that the tongue 24 of panel 10A is coplanar with plate 12B of panel 10B and the tongue of panel 10B is spaced from panel 10A just enough to accommodate angle iron connector 40 and channel members 28A and 34A.

The panels are connected together by disposing connector 40 so that one of its flanges 42 extends into the channel 26 of the confronting side edge of panel 10A and makes a snug fit with the adjacent tongue 24 and side extension 20. The other flange 42 of the connector 40 is spaced from and extends substantially parallel to the plate 12A of the panel 10A so as to form a second channel which accommodates one side plate 30A of channel member 28A. Side plate 30A makes a snug, preferably tight, fit with the adjacent flange 42 and plate 12A. The other side plate 30B of channel member 28A extends into the channel 26 of panel 10B and makes a snug, preferably tight, fit with the tongue 24 and side extension 20 of that panel. When the side plates of channel member 28A are properly positioned in the channels, the web portion 32 of member 28A is preferably flush with the outer surface of plate 12A of panel 10B. The outer channel member 34A coacts with the inner channel members 28A as previously described, so as to make a neat and vertically rigid corner joint between the two panels 10A and 10B and also provides an improved acoustical barrier at the corners. The side plates 36 of the channel member 34A extend between and make a snug, preferably tight, fit with the side flanges 42 of connector 40 on the one hand and the tongue 24 of panel 10B on the other hand. When member 34A is properly in position between the connector 40 and panel 10B, the web portion 38 is substantially flush with the tongue 24 of the panel 10A and plate 12B of panel 10B.

The double channel connector formed by inner and outer channel members 28A and 34A not only provide a load-bearing vertical corner post or column, but in addition the column is hollow and thus can function as a raceway for electrical cables, piping and the like.

Referring to FIG. 3, an alternative embodiment of the improved corner connection means is shown in the form of corner connector member 44 which preferably extends for the full height of panels 10 and comprises a pair of plates 46A and 46B which are formed and connected together so as to provide a hollow column-like structure of L-shaped cross-section characterized by a pair of outside walls 47A and 47B, a pair of right angle inside walls 48A and 48B, and a pair of mutually-converging end walls 49A and 49B, plus tongues 50A and 50B formed as extensions of the outside walls 47A and 47B and extending parallel to but spaced from the end walls 49A and 49B so as to form cross channels 52A and 52B.

End walls 49A and 49B are preferably formed at right angles to inside walls 48A and 48B, respectively, as well as to one another so that the two intersecting walls connected to corner connector member 44 form a right angled corner. It will be appreciated, however, that where it is desirable to make a corner which is other than 90°, the mutually converging angle defined by end walls 49A and 49B, equals the supplementary angle of the angle of the corner. Thus, for example, where a corner of 110° is desired, the mutually converging angles of intersection of the end walls 49A and 49B equals 70°.

In order to connect two panels 10 together to form a corner, the panels 10 are oriented at a right angle to one another and are spaced from member 44 so that a side plate 30 of a channel member 28 extends into channel 52A of member 44 while the other side plate 30 of each channel member 28 extends into the channel 26 at the confronting side edge of the corresponding adjacent panel. Each side plate 30 makes a snug, preferably tight, fit with one of the corresponding tongues 24 and 50, on the one hand, and the respective side extensions 20 and 48 on the other hand. An inner channel member 28 is inserted in place by extending the side plates 36 within and making a snug, preferably tight, fit with the tongues 50A and 24 of the respective connecting member 44 and panel 10.

Referring to FIGS. 4 - 7, a window frame assembly 54 is shown for enclosing the edges of and retaining at least one glazing panel 56 in a wall assembly of the type previously described, while preserving the modular nature and advantages of the wall assembly. The window frame assembly can be substituted for an entire panel 10 or can be used with a base and/or header panels 58 and 60, respectively, depending upon the size of the glazing panel desired. Base and header panels 58 and 60 are made identically to panels 10 except that their heights are shorter. The combined height of panels 58 and 60 together with the heights contributed by assembly 54 and panel 56 substantially equal the height of a panel 10. The panels 58 and 60 are connected to the adjacent panels 10 with inner and outer channel members 28 and 34 in the same manner as two panels 10 are connected together as previously described.

Generally, the window frame assembly 54 comprises a plurality of elongated channel members 62, each of which includes channel means having two parallel spaced-apart side plates and a web connected to and supporting the side plates, and at least two spaced-apart ribs cooperating with and extending from the members 62 for engaging opposite sides of and retaining an edge of the glazing panel 56.

Figure 5:
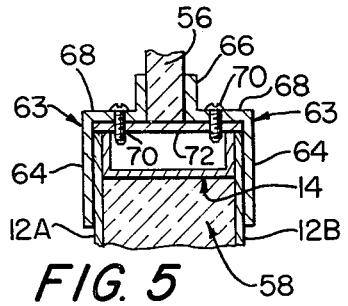
FIG. 5 is a fragmentary sectional view taken along line 5—5 of FIG. 4.
Figure 6:
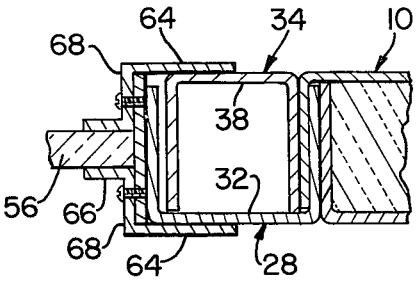
FIG. 6 is a fragmentary sectional view taken along line 6—6 of FIG. 4.

In one embodiment of the window frame assembly, shown in detail in FIGS. 5 and 6, each channel member 62 of the assembly 54A includes two brackets 63 each comprising a pair of offset and parallel side flanges 64 and 66 connected by an integral strap 68. Each strap 68 includes one and preferably a plurality of spaced holes so that two brackets can be attached in opposed relationship to opposite edges of a mounting plate 72 by any suitable means such as screws 70. The opposite ends of each bracket 63 are mitered so that the assembled channel members closely interfit with one another to provide an aesthetically pleasing, as well as structurally strong, frame assembly. When the two brackets 63 are assembled to plate 72, the flanges 66 are spaced from one another so as to engage opposite sides of and retain an edge of the flazing panel 56, while plate 72 and the straps 68 of the two brackets form the web of the elongated channel member. The width of the web formed is such that the base panel 58 is received between the flanges 64 of the lower horizontal channel member 62, as shown in FIG. 5. Similarly, although not shown in detail, the header panel 60 is received in an identical manner between the flanges 64 of the upper horizontal channel member 62. Finally, as shown in FIG. 6, the inner and outer channel members 28 and 34 (which join the base and header panels 58 and 60 to the adjacent panels 10) are received between the flanges 64 of the vertical channel members 62 in a snug, preferably tight, fitting relation. The flanges 64 are preferably dimensioned so as to extend half way between the side plates 30 of the inner channel member 28 so that when each of two adjacent panels is provided with a window frame assembly 54, the flanges 64 of the adjacent side channel members of the two window frame assemblies extend across the channel members 28 and 34 so as to leave little or no gap therebetween.

The brackets and mounting plate of the window frame assembly are preferably made of metal, such as aluminum which can be made by extrusion, or other methods known in the art. Alternatively, however, the brackets and plate can also be made of a molded or extruded plastic such as polymetharcrylate or similar material.

The window frame assembly 54 and glazing unit 56 can be mounted with the base and header panels in any one of various ways. Preferably, base panel 58 is first connected to the two adjacent panels 10, with the inner and outer channel members 28 and 34 on each side of the base panel extending substantially to the height of the adjacent panels 10. Next, the four brackets 63 of each assembly are each connected to one edge of a corresponding mounting plate 72 with screws 70. One assembled bracket and plate is positioned along the top horizontal edge of base panel 58; two others along the sides against the corner formed by the side plate 30 and web portion 32 of inner channel member 28, while the top assembled bracket and plate is positioned between the upper ends of the two side brackets. The glazing panel 56 is positioned in the frame against the side flanges of each of the bottom, side and top brackets. The other brackets are then secured with screws 70 to the opposite edges of each of the mounting plates so as to secure the glazing panel in place. The header panel 60 can then be positioned in place extending the tongues 24 of the panel into the channel provided by the space between the side plates 30 and 24 of the inner and outer channel members, and moving the bottom longitudinal edge of the header panel between the side flanges 64 of the upper channel member 62 of the window frame assembly. When assembled it will be appreciated that the stiffeners 14 of the upper horizontal edge of base panel 58 and the lower horizontal edge of header panel 60 provide an air space so that the screws 70 can extend therein without actual attachment thereto.

Figure 7:
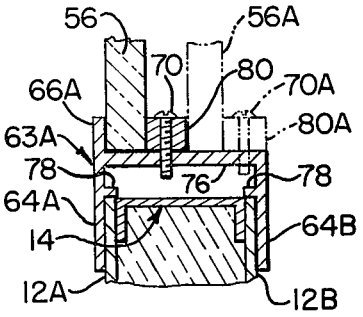
FIG. 7 is a fragmentary sectional view similar to FIG. 5 illustrating a second embodiment of the window frame assembly of the present invention.
Figure 4:
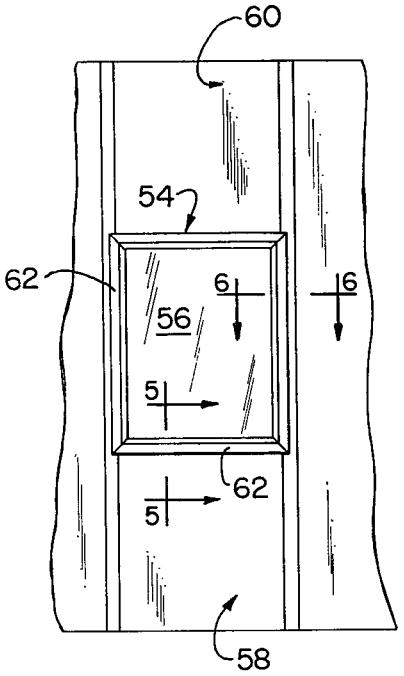
FIG. 4 is a fragmentary front view in elevation of a wall assembly including one embodiment of the window frame assembly of the present invention.

Referring to FIG. 7 an alternative channel member arrangement for the window frame assembly is shown. The assembly is similar to the window assembly previously described except that each channel member 62 is an extrusion 63A of complex shape and includes side flanges 64A and 64B integrally formed at opposite sides of and at right angles to a strap 76. Each flange 64A and 64B is preferably provided with a rib 78 spaced from the strap 76 and extending inwardly so that when the channel member is positioned on the upper horizontal edge of the base panel 58, or the lower horizontal edge of the header panel 60, an air space is provided to accommodate the screws 70. In such a case the stiffener members 14 along the upper and lower horizontal edges of the base and header panels, respectively, can be inverted as shown in FIG. 7 and attached to the plates 12A and 12B of the panels. Each extrusion also has a third flange 66A at one edge of strap 76. When the window frame assembly is assembled, on one side of glazing panel 56 each edge of that panel abuts a flange 66A of a channel member. When the glazing panel is in position it is held against flanges 66A by four retaining strips 80, each of which is secured to a strap 76 by suitable means such as the screws 70 or the like.

The window frame assembly of FIG. 7 has the advantage that where double glazing is desired, a second glazing panel 56A, can further be added by positioning it so that one side abuts the strip 80 along each edge of the panel. The addditional glazing panel is held in place be a second strip 80A which is secured to the web 76 by suitable means such as the screws 70A.

Figure 8:
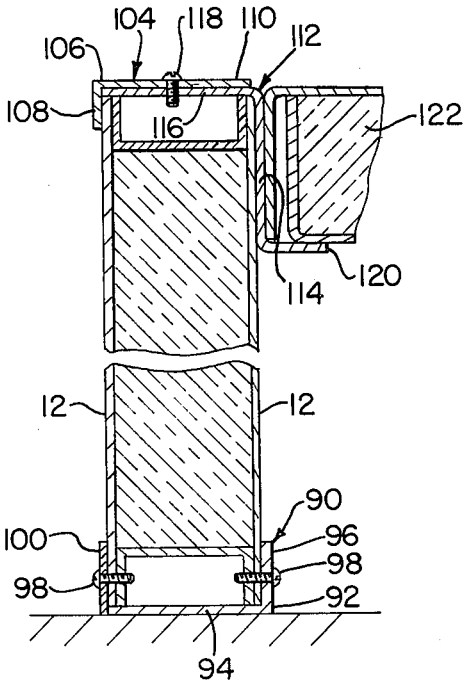
FIG. 8 is a fragmentary sectional view in side elevation of a wall assembly in use with new and preferred forms of the ceiling cap member and the floor channel member made in accordance with the present invention.

Referring to FIGS. 1 and 8, an improved floor channel member 90 is used to reinforce the lower longitudinal edges of the panels, secure the joined panels to the floor, and also restrain connector members 28 and 34 against separating movement. Floor channel member 90 includes an L-shaped bracket 92 having a strap portion 94 which is secured directly to the floor (by nails, rivets or other suitable means) and a right angled side portion 96 which extends upwardly from strap portion 94. Side portion 96 is connected to one plate 12 of each panel by any suitable means such as the screws 98 or the like. A plate 100, preferably the length of bracket 92 is attached to the opposite plate 12 of each panel by similar means such as screws 98. The bracket 92 and plate 100 define a U-shaped channel therebetween. The width of the channel is such that the lower longitudinal ends of the plates 12A and 12B make a close, preferably tight, fit with the side portion 96 and plate 100 while resting on the web portion 94. It will be appreciated that since the web portions 32 and 38 of the respective channel members 28 and 34 are flush with the plates 12A and 12B, respectively, the lower end of each connecting channel member 28 and 34 will make a close or tight fit with the side portion 96 and plate 100 of the floor channel member so as to be locked in place. The lower longitudinal edges of the panels are thus not only secured to the floor by channel member 90 but are also structurally reinforced by the latter against any lateral forces applied transversely to the panels. Further, the separate attachment of bracket 92 and plate 100 makes it easier to assemble and disassemble the panels. For example, if a panel needs to be replaced, the plate 100 can be removed and the panel replaced without the necessity of removing or destroying the bracket 92.

Improved ceiling or roof cap members 104 also are provided in order to lock together the upper ends of the members 28 and 34 of the double channel connector and also to structurally reinforce the upper margins of each of the panels 10. Each cap member 104 includes an L-shaped release bracket 106 having a side section 108 connected to a top section 110 at a right angle, and a holding bracket 112 having a side section 114 connected along one edge to a strap section 116. The latter is positioned below and connected to the top section 110 of the release bracket by any suitable means such as screws 118, so that the side sections 108 and 114 together with the strap section 116 form a U-shaped channel with right angle corners. The width of the channel is such that the upper edges of the plates 12A and 12B and channel connectors 28 and 34 fit tightly between the side sections 108 and 114 and are engaged by strap section 116. Preferably, the lower edge of the side section 114 of the cap member is provided with a right angle lip 120 to support a sound absorbing ceiling panel 122. The lip 120 extends away from the panel assembly into the room or space defined by the panel assemblies. Preferably, lip 120 is spaced from the strap section 116 so that when a sound absorbing ceiling panel 122 is supported by it, the upper surface of panel 122 will be disposed flush with the upper edges of the vertical panels.

The ceiling panels 122 are preferably identical in structure to the panels 10 and a number of them can be assembled and connected by double channel connectors consisting of channel members like members 28 and 34 to form a continuous ceiling. The ceiling panels and their double channel connectors are supported at the periphery of the ceiling by the lips 120 of cap members 104 and extend substantially parallel to the floor at right angles to the panels 10. The ceiling panels 122 are disposed so that their perforated sides face down into the room. As shown in FIG. 1, when it is desirable to utilize the double channel connectors of the ceiling as raceways to accommodate, for example, an electrical cable 124, an aperture 126 is provided in the upper end of the web portion 32 of member 28 and side section 114 of cap 104, whereby the cable 124 can extend up the raceway provided by the vertical wall double channel connector and through aperture 126 into the ceiling double channel connector.

The assembly thus described provides a modular wall and ceiling assembly which has relatively improved acoustical insulation and structural properties (as the double channel connectors provide an acoustically and structurally tight joint), can easily accommodate water and heating pipes, electrical cable and the like through the raceways provided by the inner and outer panel connectors 28 and 34, and utilizes identical panels for both wall and ceiling structures. Further, by dimensioning each of the panels 10 to that of the size of standard door frames and doors, a door frame and door can easily be substituted for one of the panels, thus making it easy to adapt the assembly to present construction demands.

Also, the plates 12A and 12B, the stiffeners 14A and 14B, (and also connector channel members 28 and 34) may be made of metal and connected together by spot welding or rivets. Alternatively, they may be made of plastic materials and locked together by a cement, suitable fasteners or ultrasonic welding.

In addition, a glazing panel 56 can easily be removed and replaced without the need to remove or replace an entire wall panel. Similarly when replacing a wall panel, the entire ceiling and wall need no be disassembled. A particular wall panel can be released for removal by removing the plate 100 and the release brackes 104 which hold its top and bottom ends in place. The panel can then be easily removed and another one inserted.

Obviously, certain changes may be made in the above apparatus without departing from the scope of the invention herein involved. Thus, for example, the tongues 24 need not extend the full length of the panels 10 but instead each may be slotted so as to form two or more smaller tongues spaced along the edge of the panel. Similarly, the side section 96 and plate 100 of the floor channel members need not be continuous but may be slotted or sectioned so that only portions of the panels 10 and the channel connectors 28 and 34 are engaged thereby. Also, if no ceiling is required, the cap members 104 may be replaced by channel members like floor channel member 90. The side plates 100 and release brackets 106 maybe made shorter or longer than the panels 10, so that the number of those members which must be removed to replace an individual wall panel will depend on the lengths of those members. Still other changes will be obvious to persons skilled in the art. Therefore, it is intended that all matter contained in the above description or shown in the accompanying drawing shall be interpreted in an illustrative and not in a limiting sense. It is to be understood that as used in the appended claims the term "wall assembly" denotes either a wall or ceiling or floor.

What is claimed is:

1. A modular wall assembly comprising in combination:

at least first and second panels with each of said first and second panels including a substantially flat body and a tongue at one edge of said body extending substantially parallel to and spaced from said body so as to form a first channel therebetween, said first and second panels being aligned and oriented so as to form a corner, a first connector member disposed between said first and second panels, said first connector member having first and second side flanges extending transversely to one another, said first side flange extending within the first channel of said first panel and making a snug fit with the adjacent tongue and body of said first panel and the said second side flange being spaced from said body of said first panel and extending substantially parallel to the plane of said body so as to form a second channel therebetween;

a second connector member disposed between said first and second panels, said second connector member having two parallel spaced-apart side plates and a web connected to and supporting said side plates, one of said side plates extending within the first channel of said second panel and making a snug fit with the adjacent tongue and body of said second panel, and the other of said side plates extending within said second channel and making a snug fit with the adjacent second side flange of said first connector member and the body of said first panel; and a third connector member disposed between said first and second panels, said third connector member fhaving two parallel spaced-apart side plates and a web connected to and supporting said side plates, the side plates of said third connector extending between and making a snug fit with said tongue of said second panel and said second side flange of said first connector member.

2. In a modular wall panel assembly comprising at least first and second panels each including a substantially flat body and a tongue at one edge of said body extending substantially parallel to and spaced from said body so as to form a first channel therebetween, a first connector member having first and second side flanges extending transversely to one another, second and third connector members each having two parallel spaced-apart side plates and a web connected to and supporting said side plates, the improvement comprising:

said panels being positioned so that the planes of said panels extend transversely to one another at a predetermined angle; the first side flange of said first connector extending within the first channel of said first panel so as to make a snug fit with the adjacent tongue and body of said first panel and so that the second side flange is spaced from the body of said first panel and extends parallel to the plane of said body so as to form a second channel therebetween; one of said side plates of the second connector member extending within the first channel of said second panel so as to make a snug fit with the adjacent tongue and body, and the other of the side plates of the second connector extending within said second channel so as to make a snug fit with the adjacent second side flange of said first connector member and the body of said first panel; and the side plates of said third connector extending between the tongue of said second panel and the second side flange of said first connector member so as to make a snug fit.

3. A wall assembly according to claim 2 wherein said first and second connector members are U-shaped channel members.

4. A wall assembly according to claim 2 wherein said first and second connector members coact to form a hollow column between said panels.

5. A wall assembly according to claim 2 further including means forming a main channel, and further wherein each of said panels has a bottom longitudinal edge disposed within said main channel.

6. A wall assembly according to claim 2 wherein said panels each have a top longitudinal edge and further including a cap member overlying said top longitudinal edge of at least one of said panels.

7. A wall assembly according to claim 6 wherein said cap member includes a lip for supporting at least one additional panel so that it extends at a right angle to the plane of said at least two panels.

8. A wall assembly according to claim 2 wherein each panel body comprises a pair of spaced wall plates and means extending between and connecting said wall plates so as to maintain said plates in parallel spaced relationship to one another.

9. A wall assembly according to claim 8 wherein said last mentioned means comprises at least one stiffener member having two side flanges with each side flange being secured to a corresponding one of said wall plates.

10. A wall assembly according to claim 9, wherein each panel has one of said tongues at each of two opposite edges of one of said wall plates, and further wherein said stiffener member has two end flanges which extend transversely of its side flanges and are secured to extensions of the other wall plate.

11. A wall assembly according to claim 10, wherein each stiffener has a corner relief between its side and end flanges.

12. A wall assembly according to claim 8, wherein each of said panels further includes sound absorbing material disposed between said wall plates.

13. A wall assembly according to claim 12 wherein at least one of said wall plates has sound transmitting openings therein.

14. A wall assembly in accordance with claim 8, wherein said tongue is integrally formed with one of said plates.

15. A wall assembly in accordance with claim 13, wherein the other of said plates includes at least one side extending portion spaced from said tongue and defining one side of said channel.

16. A wall assembly according to claim 2 wherein said first and second side flanges of said first connector extend at substantially right angles to one another.

17. A wall assembly comprising in combination:

at least first and second panels, each including a substantially flat body and a tongue at least one edge extending substantially parallel to and spaced from said body so as to form a first channel therebetween, said panels being aligned and oriented so as to form a corner;

a corner connector member including a body having two mutually converging side edges and a flange at each of said side edges of said body extending substantially parallel to and spaced from said body so as to form a second channel at each of said edges; and first, second, third and fourth connector members, each having two parallel spaced-apart plates and a web connected to and supporting said side plates, one of said side plates of said first connector member extending within said first channel of said first panels and making a snug fit with said tongue and said body of said first panel and the other of said side plates of said first connector extending within one of said second channels of said corner connector member and making a snug fit with one flange and the body of said corner connector member, said side plates of said second connector member extending between and making a snug fit with said one flange of said corner connector member and the adjacent tongue of said first panel said side plates of said third connector member extending within said first channel of the said second panel and making a snug fit with said tongue and said body of said second panel and the other of said side plates of said third connector member extending within the other of said second channels of said corner connector member and making a snug fit with the other flange and the body of said corner connector member and said side plates of said fourth connector member extending between and making a snug fit with said other flange of said corner connector member and the adjacent tongue of said second panel.

18. A wall assembly according to claim 17, wherein said first, second, third and fourth connector members are each U-shaped channel members.

19. A wall assembly according to claim 17 wherein said corner connector member is of an L-shaped cross-section.

* * * * *